US005562522A

United States Patent [19]

Richno

[11] Patent Number: 5,562,522

[45] Date of Patent: Oct. 8, 1996

[54] LINE GUIDED SELF PROPELLED VEHICLE

[76] Inventor: Kim A. Richno, 611 Vance Ave., Paris, Ill. 61944

[21] Appl. No.: 395,666

[22] Filed: Feb. 28, 1995

[51] Int. Cl.[6] ..... A63H 18/00; A63H 29/18

[52] U.S. Cl. ..... 446/444; 446/459

[58] Field of Search ..... 446/444, 459, 446/441, 454, 451, 228, 229, 435; 273/86 R

[56] References Cited

U.S. PATENT DOCUMENTS

| | | | |
|---|---|---|---|
| 3,474,566 | 10/1969 | Cagan et al. | 446/459 |
| 3,844,557 | 10/1974 | Pompetti | 446/444 X |
| 3,950,889 | 4/1976 | Dabney | 446/444 X |
| 4,080,750 | 3/1978 | Palumbo | 446/228 |

FOREIGN PATENT DOCUMENTS

| | | | |
|---|---|---|---|
| 1555738 | 11/1979 | United Kingdom | 446/451 |

*Primary Examiner*—Mickey Yu
*Attorney, Agent, or Firm*—Robert A. Brown

[57] ABSTRACT

A toy vehicle using a rubber band drive operates in conjunction with a guide line that is associated with the vehicle. The vehicle includes a plurality of guides through which the guide line is threaded. The guide line is suspended between anchor stakes and includes a splayed end portion at a terminus of the guide line. An obstruction on the guide line will interface with a ring on the vehicle. When the ring becomes fouled by the obstruction it will cause the deployment of a parachute from the vehicle.

17 Claims, 3 Drawing Sheets

LINE GUIDED SELF PROPELLED VEHICLE

BACKGROUND OF THE INVENTION

1. Field of the Invention

The invention disclosed herein is a toy automobile, configured as a "dragster," being self-propelled by an onboard drive means. The vehicle is provided with a line engaging guide for receiving a guide line that the vehicle will follow as it speeds along in competition with another similar vehicle. The means of propulsion can be one of several means but in the preferred embodiment will be an elastic cord, for instance, a rubber band that is wound up and ultimately unwound to drive the vehicle through various drive means including an angle drive gear in the rear axle of the vehicle. The invention also includes a guide line mounted means for interacting with the vehicle to trigger the deployment of a vehicle carried element.

2. Background Information

Numerous toy vehicles exist in the art. The particulars of the vehicle presented herein includes a combination of features that have not, to my knowledge, been put together in a similar way in the vehicles existing in the market today. The three major elements incorporated in the invention are: 1) a guide line that the vehicle will follow during its "run," 2) a trip mechanism on the guide line that causes a responsive action on the vehicle, and 3) a rubber band or bungie cord energy storage means that is used to provide the potential energy which, when released, will propel the vehicle along the guide line at a rapid velocity. Several other elements are included in the assemblage of the toy vehicle as will be discussed in the detailed description of the invention.

The prior art in this field would include various line guided vehicles that are designed to follow the guide line along a straight path. The vehicle would be self-propelled and have only a limited, as opposed to an extended, running time. One such toy would be carbon dioxide powered "rockets," sometimes played with by groups of children under the supervision of parents or group leaders. The rocket toy starts out as a wooden block, usually pine, having a cavity for accommodating a carbon dioxide cartridge. The block is carved, whittled, sanded and otherwise shaped by the child into a design that the child (and oftentimes the child's parent) believes to be a desirable shape. The completed rocket is then fitted with a pair of guide line engaging elements ("screw eyes") that will receive the guide line before the rocket is launched. Usually the rocket is used in competition against the creation of another child. Side-by-side guide lines are set up so that one rocket can match race the rocket of the other child. The carbon dioxide cylinders of the competitor's creations are simultaneously discharged and the projectiles accelerate down their respective guide lines reaching a maximum velocity then, at some point, are stopped by an obstacle at the end of the guide line—usually a padded barrier of some type. The first projectile to reach the barrier is declared the winner of the match race.

It is expected that there are gravity propelled rocket vehicles of the type described above with the difference being that the carbon dioxide cartridge is not used. The projectile is simply let go or launched at a higher elevation than the finish line elevation of the guide line.

The invention present herein is not a line guided toy rocket but is an invention in the exciting world of wheeled vehicles.

In this art, the art of wheeled toys, the most typical embodiments of toy cars are those that are either steerable vehicles, such as the very sophisticated radio controlled cars, or the less sophisticated cars guided by a slot and pin arrangement. Gravity powered toy cars run in tracks with upstanding curbs to contact the toy car's tires and keep the car on the track. The toy car presented here is unique in that it is line guided, self-propelled by means other than gravity and includes a feature, the feature of a guide line mounted triggering device, to interface with apparatus carried by the vehicle. The device on the vehicle that is triggered by the line mounted triggering device could be one or more of several things, but in a preferred embodiment is a "drag chute" carried on the vehicle and released by the triggering device as the vehicle crosses a finish line.

SUMMARY OF THE INVENTION

The car can best be envisioned as being painted and having numerous decals thereon in the style and livery of the highly publicized competition cars such as those raced on the drag strips of America. These cars are known as "dragsters," "diggers," "rails," or as "funny cars" when provided with a wheel covering body. I strove to present an exciting and fun car, for instance, a miniature simulated "double A fuel dragster," that was easy to operate and did not require a large investment in either prime movers or in controls for guiding the vehicle. I'll refer to the car as a "dragster" in this write-up. The excitement of this vehicle is not only in the thrill of seeing the vehicle blast down a race track following a guide line in competition with a race car on an adjacent path, but having that fun raised to an even higher level with the deployment of the drag chute toward the end of the run.

The dragster will have a chassis 16 accommodate the body. The chassis will have a frame of significant strength, high impact plastic would be preferred, to accommodate the lateral compression on the chassis as the elastic cord drive is wound up in preparation of the "launch" off the starting line. The elastic cord will be attached to the chassis and to a gear box associated with the drive axle of the car.

The bottom side of the chassis will have a pair of guide line guides, typically one at the front of the chassis and one at the rear of the chassis, through which the guide line will be threaded.

Attached to the guide line toward the end of the "run" there will be an obstruction of sorts that is of small enough dimension to allow the passage of the guide line guides over the obstruction. The obstruction however will be too large to let a ring element carried on the chassis to pass the guide line obstruction. Thus the ring will foul on the obstruction and trigger an action relative to the dragster. In one embodiment the action would be the release of a drag chute to slow the dragster and signal that the dragster had reached the obstruction. This could also signal to the participants which dragster first finished a match race against a dragster on an adjacent guide line.

The actual embodiment of the toy race car presented herein will be easily understood through a perusal of the drawing figures presented herewith in conjunction with a careful reading of this disclosure.

BRIEF DESCRIPTION OF THE DRAWING FIGURES

In the drawing figures:

FIG. 1 is a top view of a simplified dragster chassis,

FIG. 2 is a side view of the chassis of FIG. 1, with the front portion removed, and showing the guide line obstruction relative to the dragster chassis, FIG. 3 is a representation of a winding implement, FIG. 4 is a top view of a guide line set up to accept a car, FIG. 5 is a guide line stake, FIG. 6 is the chassis of FIG. 1 with the elastic drive wound up and ready to race, FIG. 7 is a representation of two dragsters ready to race.

FIG. 8 is a representation of a dragster race car with the body assembly disposed on the chassis.

DESCRIPTION OF THE PREFERRED EMBODIMENT

Figure 1:
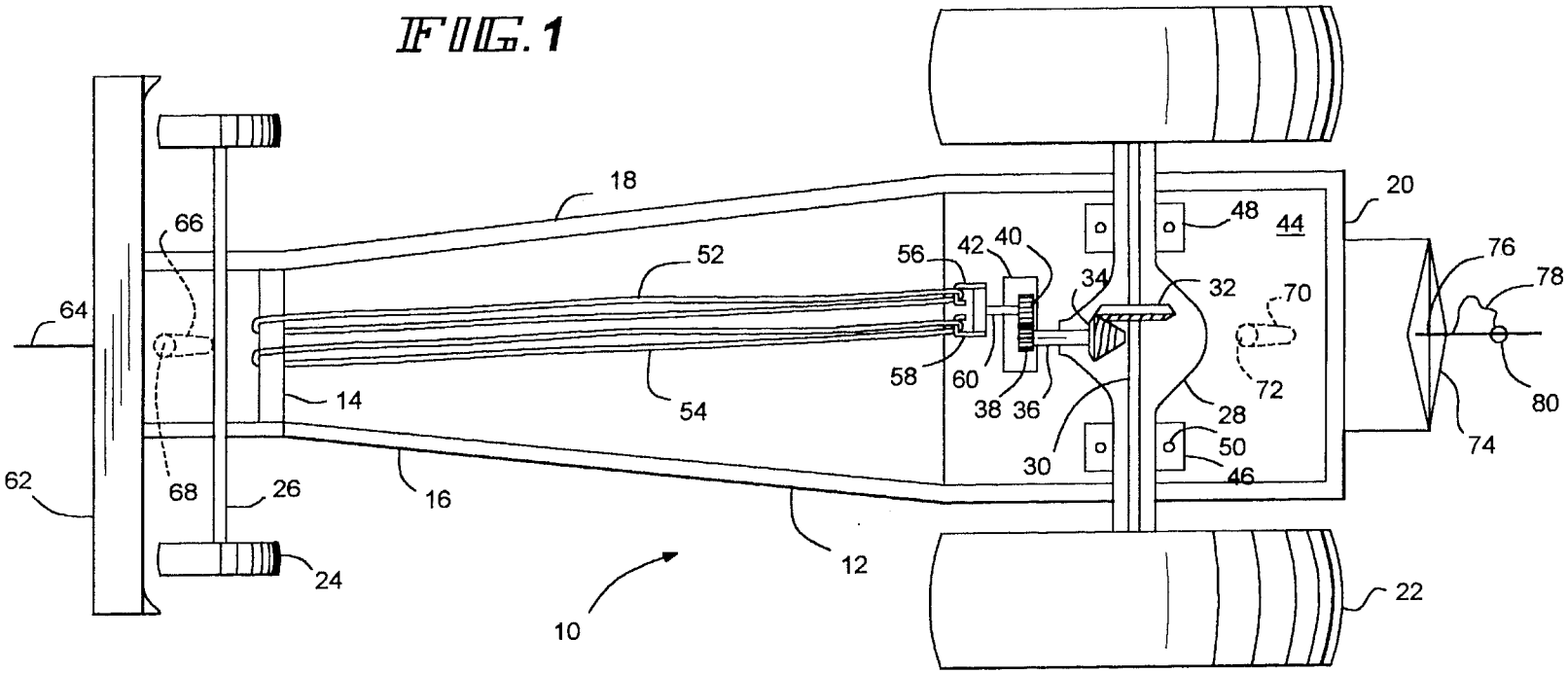
Figure 2:
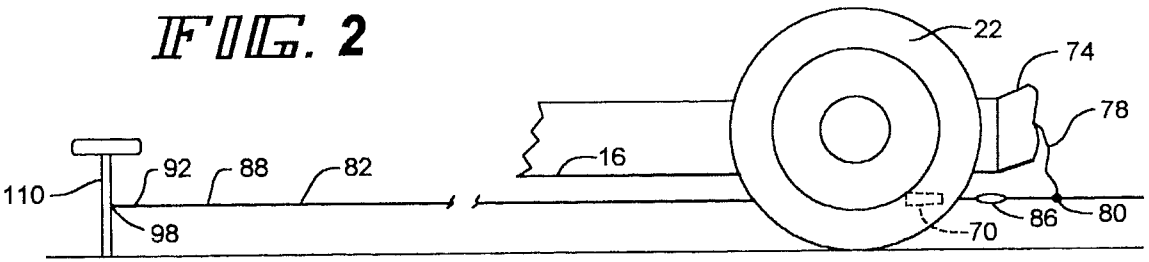

The invention can be most readily appreciated by a close look at FIG. 1. In this figure, and the other figures as well, like numbers refer to like parts of the invention.

To give the reader a reference as to the size of this dragster, I envision that it will be between thirty and forty inches long and race down a "drag strip" defined by the guide line of one hundred fifty to one hundred seventy-five feet long. Turning to FIG. 1, the top view of a race car with the optional body removed is shown generally as 10. The frame of the vehicle 12 includes a forwardly mounted transverse member 14 extending from a left side frame rail 16 to a right side frame rail 18. The transverse member 14 will be a significant structural member capable of resisting a significant force imposed on it from the rear of the chassis. A rear transverse member 20 connects the left side frame rail to the right side frame rail at the rear of the chassis. The frame rails will also be significant structural members with appropriate cross-bracing and gussets as necessary. Various tabs and flanges could be mounted on the frame rails and chassis to provide locations to mount the body and locate pseudo engine and accessory elements normally found on full size dragsters.

The body that will overlay the chassis would be a plastic, vacuum formed shell commonly used on radio controlled cars. These bodies come in innumerable sizes and shapes and are found in hobby shops and through mail order suppliers. The bodies are normally painted on the inside and decals are then applied to the exterior of the shell. The final product, depending on the skill, creativity, and experience of the painter and the quality of the decals used, can be made to look like the colorful full size dragsters. It is expected that this decorating of the dragster body would be done on the dragsters by the children and adults practicing my invention. There can be a wonderful bond formed between a parent and a child when the parent and child are working and playing together. One advantage of this invention is that it is relatively "parent participative" meaning that parents would be involved with youngsters in building, setting up and racing these dragsters.

The chassis is supported on drive wheels such as 22, depicted in the embodiment shown as drag slicks appropriate for a toy car, possibly of light weight foam, the chassis being constructed to be a simulation of a full size "dragster" or "funny car" depending on the body overlaid on the chassis. The front of the chassis is supported on front wheels such as 24 located at the outboard ends of the front axle 26. This axle is a non-steerable axle in this embodiment. A solid floor portion may extend under the front portion of the vehicle or alternatively under the entire vehicle as desired.

The rear axle carrier 28 is the housing for the rear axle, in this case a driven axle 30, which is turned by means of elements of gear means including a ring 32 and pinion 34 gear assembly of the type, scaled down to miniature size, normally found in full size production cars. The ring and pinion gear set is a preferred embodiment however a much simpler drive gear arrangement is possible and has been contemplated. Given the rather large size of the vehicle and the forces anticipated it is expected that metal gears and axles would be preferred over Nylon or plastic parts—which could, however, be used.

The pinion gear 34 is supported on a pinion gear shaft 36 which extends out from the rear axle carrier 28 toward the front of the chassis and extends into a gear drive housing 42. The pinion shaft may have a driven gear 38 attached thereto. This driven gear 38 will be driven by a drive gear 40 which is also carried in the gear drive housing 42. The gear drive housing 42 is carried on the floor of the chassis which is shown as floor plate 44. These elements are also part of the gear means mentioned above.

Figure 6:
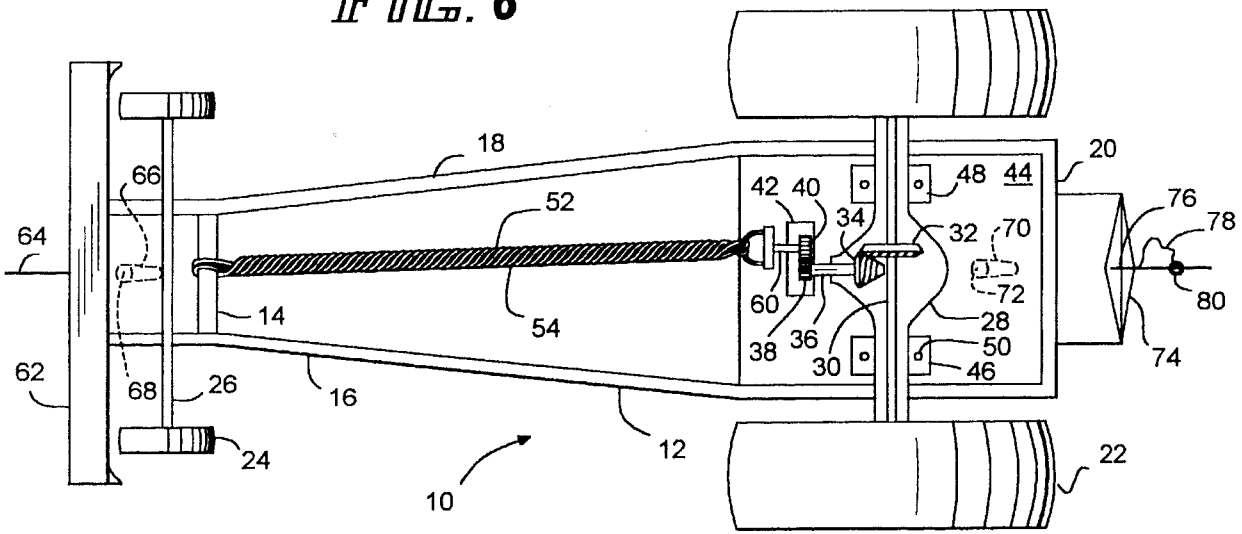

The input shaft 60 extends out of the gear drive housing 42 and is integral with a pair of attachment hooks 56 and 58. A single loop shaped structure could be used in place of these hooks as is shown in FIG. 6 and described further on. Secured on each attachment hook is one of the two rubber bands 52 and 54, respectively. Two rubber bands are shown in this preferred embodiment however any reasonable number of rubber bands, including a single rubber band, could be used. These rubber bands may be silicone rubber bands, woven elastic bungie cords, or other elastic cords of suitable similar materials that will perform the same function as the rubber bands. These elastic cord means are provided to store potential energy in the same manner as is well known in rubber band driven airplanes. While one end of each rubber band is attached to the attachment hooks 56 and 58 the other ends are attached to one of the transverse member 14 at the front of the vehicle. Attachment to the transverse member 14 can be accomplished by extending a removable transverse member through the rubber bands as shown or by looping the rubber bands over the transverse member and extending them back to the attachment hooks.

At the front of the vehicle, in front of the spoiler 62, a portion of the guide line 64 which will be the guide line to which the vehicle is attached is seen. The guide line will be threaded through two or more guides on the bottom of the vehicle. The front guide line guide 66, shown hidden beneath a floor plate at the front of the vehicle, has a wider opening at the inlet end thereof and is tapered down to a smaller or reduced diameter outlet end. A similar guide line guide is carded on the rear of the vehicle below the solid floor plate 44. These guides can optionally have an interrupted circumference, such as a slit running the length of the guide to allow the guide line to be positioned in the guide without the need to thread the guide line into the guide from the end of the guide line. The obstruction, mentioned further on, can pass through these guides without fouling as they have a large internal diameter that is larger then the peripheral dimension of the obstruction.

The guide line 64 would preferably be ten pound test fishing line or other suitable synthetic, metal or natural fiber material. It would extend for a length of between one hundred fifty to one hundred seventy-five feet from an anchor stake 84 to a junction 88 where the line will be connected to another line forming right 90 and left 92 legs extending from the main straight portion of the guide line at approximate angles of forty-five degrees. These splayed legs will be anchored to anchor stakes 94 and 96 which are usually more than one hundred feet away from the first anchor stake. In a setup where two or more vehicles will be racing, as is shown in FIG. 7, it would be appropriate to have one of the anchor stakes such as 94 connected to a second leg of an adjacent guide line.

Figure 5:
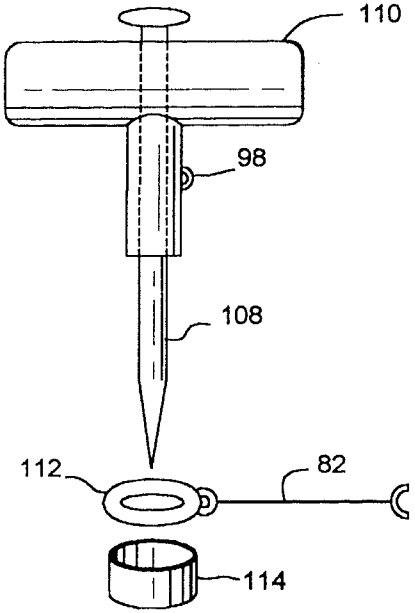

An anchor stake is shown in FIG. 5. In this figure a spike 108 is shown threaded through a through bore or aperture in a handle portion 110. The spike will be pushed or pounded into the ground or through a smooth hard surface such as asphalt pavement by the person setting up the "drag strip." The guide line could be attached to a loop 98 on the handle portion or to a loop on a ring 112 through which the spike is passed. The loop 112 will have an inside diameter less than the outside diameter of the downwardly extending portion of the handle 110 and thus be upwardly restrained by the lower portion of the anchor stake. A spacer 114 could also be used to elevate the ring 112 and the guide line above the surface of the ground if necessary.

Figure 4:
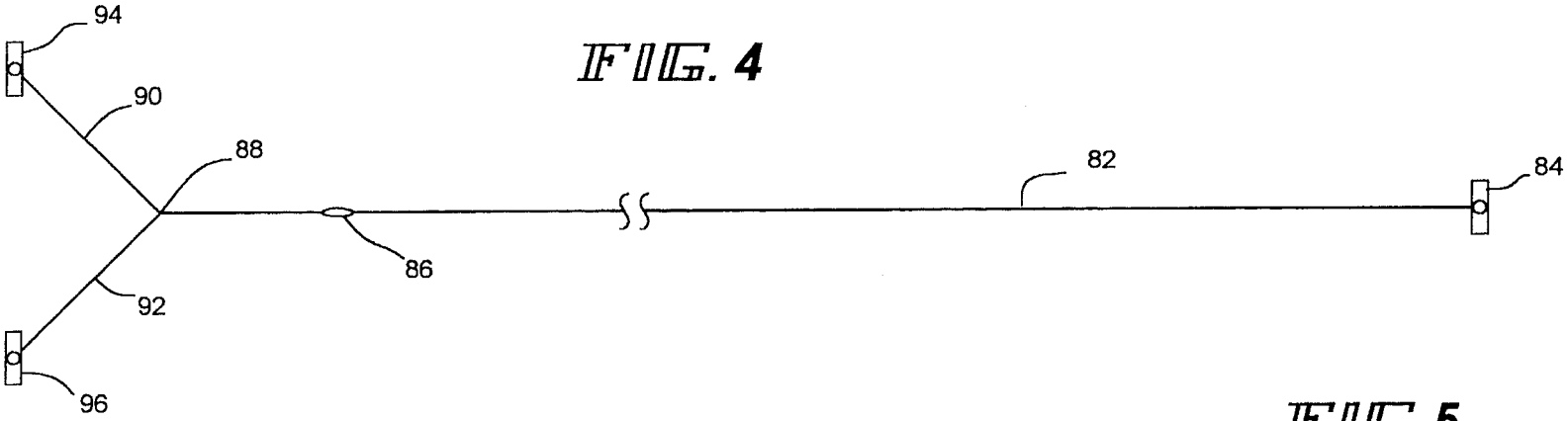
Figure 7:
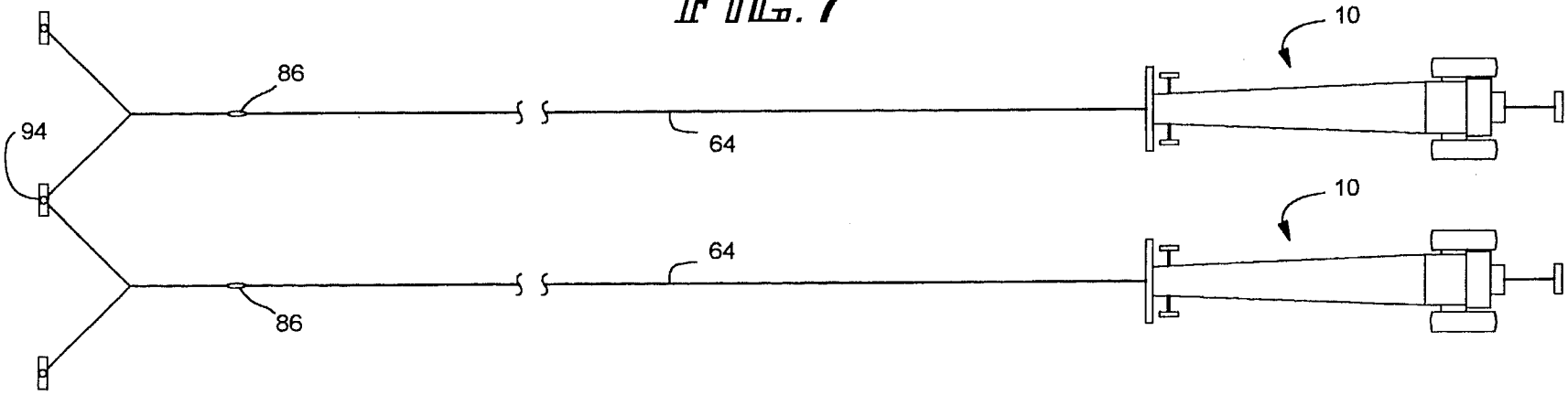
Figure 8:
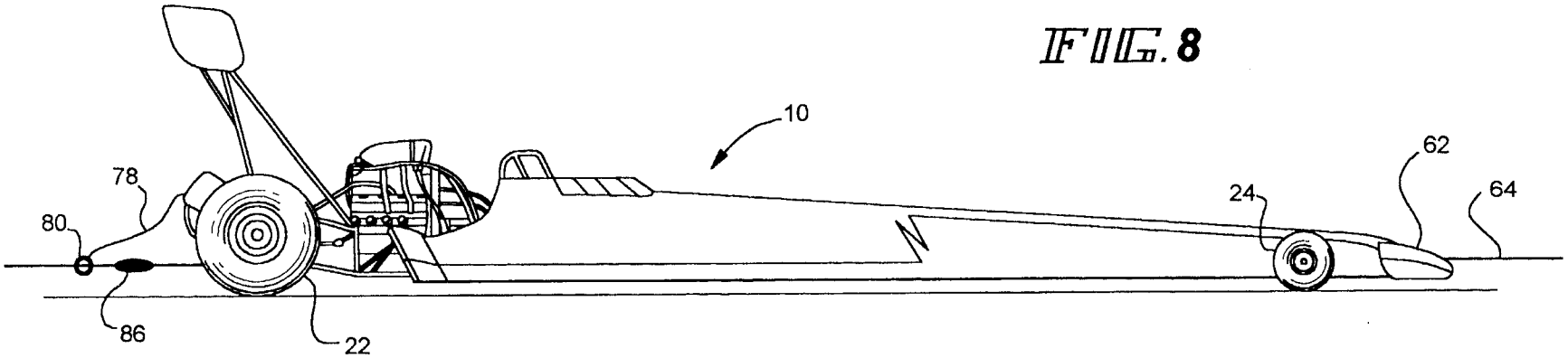

Returning to the description of the guide line shown in FIGS. 4 and 7, it is seen that just prior to the junction 88 a trigger obstruction 86, which in a preferred embodiment could be a lead fishing weight crimped to the guide line, is positioned. This obstruction 86 will be small enough to fit through the guide line guides, 66 and 68, on the bottom of the dragster. It will, however, be too large to fit through a catch ring 80 carried on the end of a lanyard. The lanyard is attached at a second end thereof to one element of a two element hook and loop closure at the rear of the dragster, actually to the parachute package. The obstruction will in fact cause the catch ring to be restrained proximate the trigger obstruction. The catch ring will be restrained as the dragster continues to move along the guide line. The lanyard will separate a hook and loop closure from a drag chute containing package 74 thus allowing a parachute in the package to be released. The drag chute package may include an internal spring to positively launch the chute. The parachute will deploy and slow the drag car after the dragster passes the trigger obstruction 86. Deployment of the chute will also serve to indicate which of the match race dragsters has reached the end of the drag strip first. The catch ring, its lanyard and one portion of the hook and loop closure will be left in the vicinity of the triggering obstruction. The chute will stay attached to the dragster.

Figure 3:
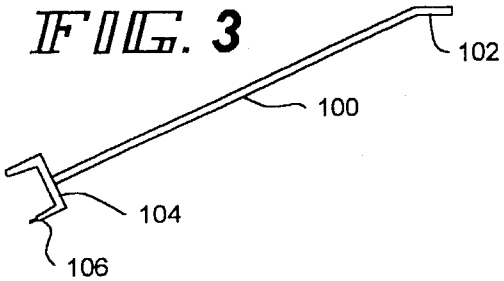

In a windup car of the type contemplated it would take an inordinate amount of time to windup the rubber bands for a one hundred fifty foot run. Thus the provision for winding the car using the winding stick is provided. In FIG. 1 winding stick receivers 46 and 48 are provided to secure temporary connection of the winding stick means to the dragster. These receivers are flanges attached to the dragster in the vicinity of the rear axle that have apertures such as 50 to receive probes such as 106 on the winding stick shown in FIG. 3.

The winding stick means 100, or simply "the winding stick," on the order of thirty inches long, includes a bent over handle portion 102. The other end of the winding stick includes a spreader portion 104 with the probes 106 extending therefrom. The probes are spaced to line up with holes on the winding stick receivers 50 while clearing the hump of the axle carrier. With the chute packed in the package and the dragster at the finishing end of the track the winding stick is inserted into the apertures on the winding stick receivers and the car pushed backward along the guideline to the anchor stake 84. The winding stick allows pressure to be exerted on the axle of the vehicle to minimize wheelspin as the rubber bands get fighter. By the time the dragsters are pushed back to the starting point—the elastic cord means is woundup as the gear means is rotated through the rotation of the drive wheels of the vehicle—the rubber bands are ready to propel the cars to the other end of the track.

A dragster with the body removed that is ready to be launched is shown in FIG. 6. Here the dragster has been pushed back as described above and the rubber bands 52 and 54 are in the fully wound state. In this figure an alternative, but preferred, rubber band attachment loop is used to attach the rubber bands to the input element of the gear drive assembly.

FIG. 7 shows two dragsters in a simplified presentation ready to race.

After the dragsters are woundup a significant amount of kinetic energy has been stored and converted to potential energy. The dragsters are ready to race along the taut guide line 82. The participants will simply count down to "go" and release their hold on the dragsters. The dragsters will travel down the guide lines 82 toward the "Y" junction—the junction of the two segments of line far away from the first anchor stake. Just before getting to the junction the catch rings 80 will foul on the obstructions 86 causing the chutes to be deployed signaling the end of the race and slowing the dragsters. Chute deployment will be an indication to the racers that the race is over. The dragster's chute that opens first is the winner. The racers will repack the chutes, position the winding stick and push the dragsters back to the starting zone near the anchor stake 84 for another race.

One other feature of this invention is that the rubber band drive could be used to replace an electric motor drive in a similar dragster embodiment. Often the battery operated versions of toy cars, such as radio controlled cars, have limited battery life resulting in downtime when the car can't be run as the battery is being recharged. In these situations the battery pack and other hardware as necessary could be removed and the rubber band drive hooked up. This would allow the racing to continue to the pleasure of the children and adults involved in the session. The hook type rubber band attachment elements 56 and 58 would be especially convenient in this situation.

It should be appreciated that I have disclosed a particular embodiment of my invention but that various modifications could be made that are within the scope of this disclosure. The following claims intend to cover such modifications that may be within the spirit and scope of the invention.

What is claimed is:

1. Apparatus comprising a toy vehicle having a frame structure including a forwardly mounted transverse member, said frame structure supported on a plurality of wheels including a pair of drive wheels carried on an axle supported in a rear axle carrier; and a winding stick means for temporary connection to said toy vehicle, the improvement comprising:

gear means carried by said rear axle carrier for driving said axle;

winding stick receiving means carried by said rear axle carrier for receiving said winding stick means;

elastic cord means connected to said forwardly mounted transverse member and to said gear means, said elastic cord means capable of storing potential energy;

a plurality of guides carried on said frame of said vehicle;

a guide line threaded through said guides on said frame;

an obstruction, having a diameter capable of passing through said guides without fouling, carried on said guide line;

a catch ring removably carried by said toy vehicle, said catch ring having an inner diameter less than said diameter of said obstruction whereby said obstruction will foul said catch ring preventing said catch ring from traversing said obstruction.

2. The invention in accordance with claim 1 wherein said catch ring is removably carried by said toy vehicle by means of a lanyard connected at one end thereof to said catch ring and at a second end thereof to one element of a two element hook and loop closure.

3. The invention in accordance with claim 1 wherein said elastic cord means is woundup as said gear means is rotated through the rotation of said drive wheels of said vehicle.

4. The invention in accordance with claim 3 wherein said guides have an interrupted circumference to allow said guide line to be inserted into said guide.

5. The invention in accordance with claim 3 wherein said elastic cord is a rubber band.

6. The invention in accordance with claim 3 wherein said elastic cord is a woven elastic bungie cord.

7. An elastic cord driven vehicle and a guide line along which said vehicle can be guided, said vehicle including a gear drive means for receiving kinetic energy as rotary motion from said elastic cord, the improvement comprising:

gear drive means including a ring and pinion gear set, said pinion gear receiving rotary motion input from a drive gear connected to and driven by said elastic cord;

guides having an inside diameter carried by said vehicle;

a catch ring carried by said vehicle, said catch ring having an inside diameter less then the inside diameter of said guides;

an obstruction carried on said guide line which will foul said catch ring as said vehicle moves along said guide line as a result of said elastic cord driving said gear drive means of said vehicle.

8. The invention in accordance with claim 7 wherein said guides have an interrupted circumference to allow said guide line to be inserted into said guide.

9. The invention in accordance with claim 7 wherein said elastic cord is a rubber band.

10. The invention in accordance with claim 3 wherein said elastic cord is a woven elastic bungie cord.

11. The invention in accordance with claim 7 wherein said catch ring is connected by a lanyard to a parachute containing package carried on said vehicle whereby said parachute will be ejected from said package when said catch ring fouls said obstruction.

12. The invention in accordance with claim 11 wherein said parachute containing package contains a spring to assist ejection of said parachute from said package when said parachute ejection is initiated.

13. The invention in accordance with claim 7 wherein said guide line comprises:

a length of line terminating at one end thereof at a juncture of two other segments of line;

a first anchor stake which can be pushed into the ground to which one end of said line is attached:

a pair of anchor stakes which can be pushed into the ground to which said two other segments of line are attached, said pair of anchor stakes located more than one hundred feet away from said first anchor stake.

14. The invention in accordance with claim 13 wherein said obstruction is attached to said guide line before the juncture of said two other segments of line from the location of said first anchor stake.

15. The invention in accordance with claim 13 where each anchor stake comprises:

a spike:

a handle portion having a through bore through which the spike is positioned;

a ring through which the spike is positioned after it passes through the handle, said ring having a loop thereon to which said line is attached.

16. The invention in accordance with claim 15 further comprising a spacer through which said spike may pass to prevent said ring from contacting the ground when said spike and anchor is positioned in the ground.

17. The invention in accordance with claim 13 where each anchor stake comprises:

a spike:

a handle portion having a through bore through which the spike is positioned;

a loop formed on said handle portion for attachment thereto of said guide line.

* * * * *